United States Patent [19]

Hildebrandt

[11] 4,200,138

[45] Apr. 29, 1980

[54] PROCESS FOR THE SHIELDING OF A CASTING STREAM IN A CASTING APPARATUS

[75] Inventor: Peter Hildebrandt, Kransberg, Fed. Rep. of Germany

[73] Assignee: Linde Aktiengesellschaft, Wiesbaden, Fed. Rep. of Germany

[21] Appl. No.: 928,367

[22] Filed: Jul. 27, 1978

Related U.S. Application Data

[63] Continuation of Ser. No. 778,461, Mar. 17, 1977, abandoned.

[30] Foreign Application Priority Data

Mar. 17, 1976 [DE] Fed. Rep. of Germany ..... 2611353
Dec. 9, 1976 [DE] Fed. Rep. of Germany ..... 2655919

[51] Int. Cl.[2] ..... B22D 11/10
[52] U.S. Cl. ..... 164/66; 164/82; 164/259; 164/415
[58] Field of Search ..... 164/66, 82, 415, 437, 164/259; 75/59, 60

[56] References Cited

U.S. PATENT DOCUMENTS

| | | | |
|---|---|---|---|
| 3,482,621 | 12/1969 | Halliday | 164/259 X |
| 3,608,621 | 9/1971 | Bollig et al. | 164/415 X |
| 3,908,734 | 9/1975 | Pollard | 164/259 X |

FOREIGN PATENT DOCUMENTS

| | | | |
|---|---|---|---|
| 228418 | 7/1963 | Austria | 164/415 |

*Primary Examiner*—Robert D. Baldwin
*Assistant Examiner*—Gus T. Hampilos
*Attorney, Agent, or Firm*—Karl F. Ross

[57] ABSTRACT

A process for shielding molten metal of a casting stream in a casting apparatus from oxidation by the ambient atmosphere which comprises enclosing the casting stream in an atmosphere which consists essentially of a mixture of an inert gas such as nitrogen as a carrier and a reactive gas, such as a hydrocarbon, capable of reacting with oxygen in the melt. The gas atmosphere preferably consists of a mixture containing 5 to 20% by volume of the reducing gas, namely, the hydrocarbon, the balance being the carrier gas namely nitrogen. Any conventional technique can be used to ensure that the gas mixture covers the casting stream.

2 Claims, 4 Drawing Figures

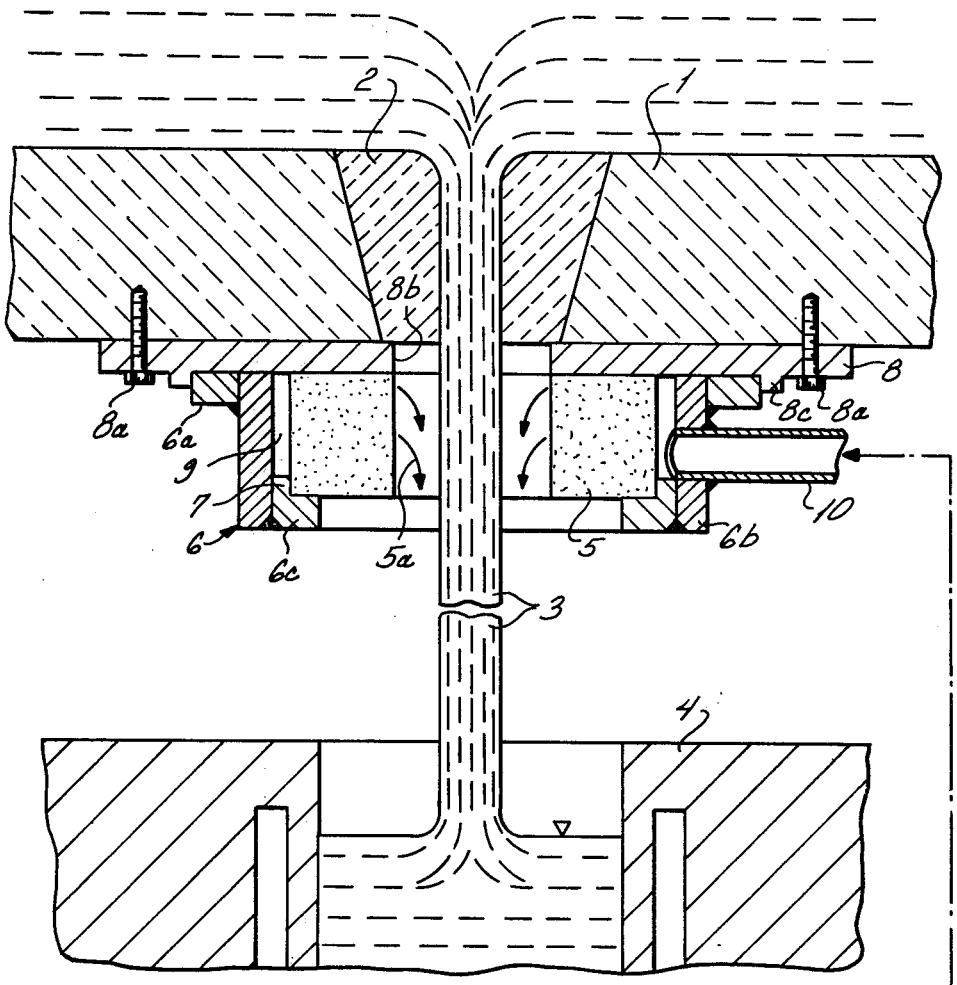
FIG. 1
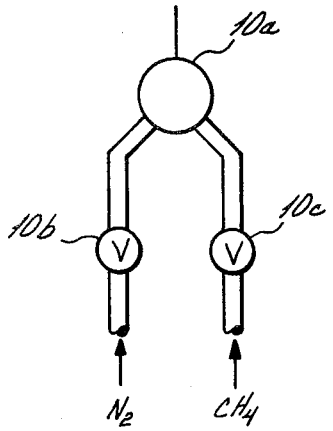

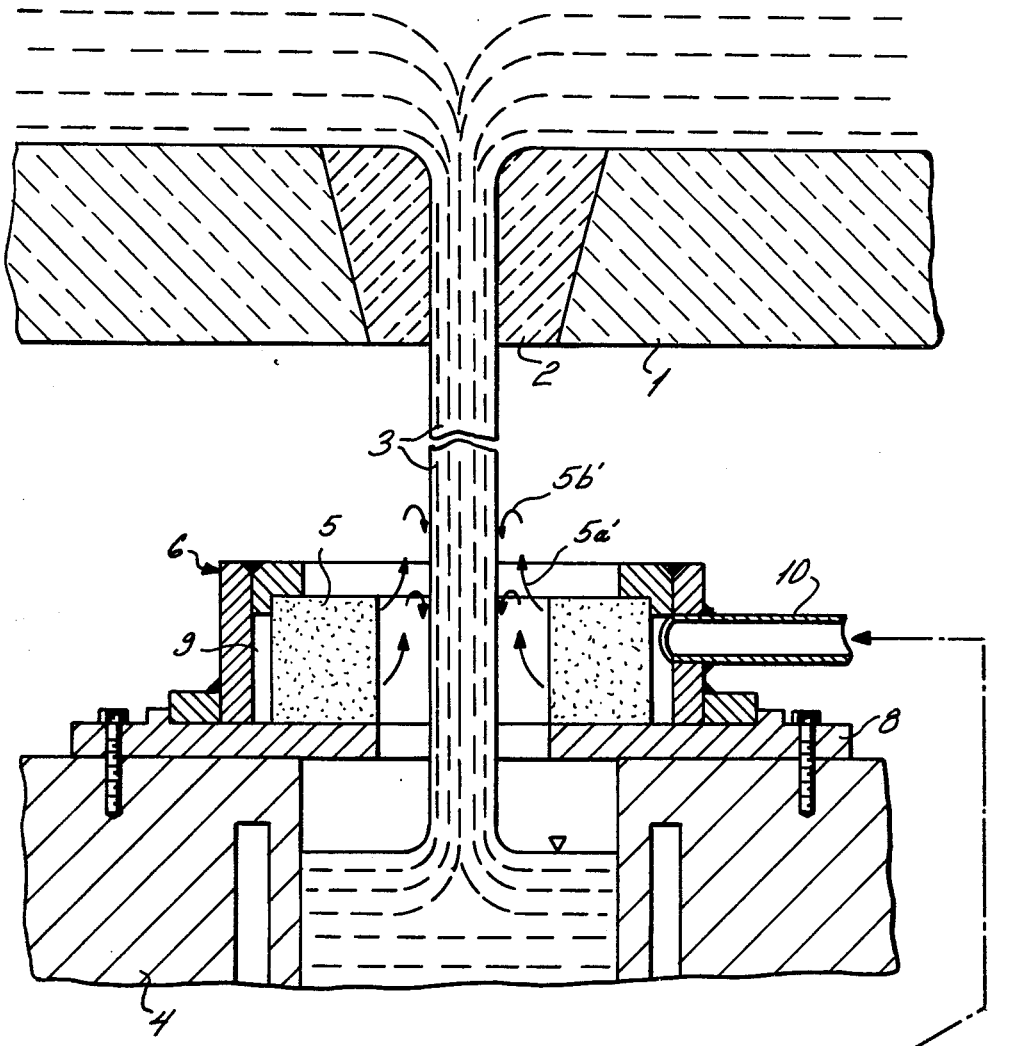
FIG. 2
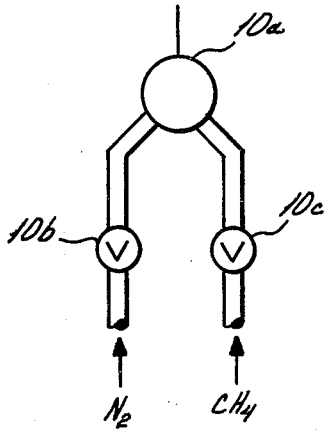

PROCESS FOR THE SHIELDING OF A CASTING STREAM IN A CASTING APPARATUS

This is a continuation of application Ser. No. 778,461, filed Mar. 17, 1977, now abandoned.

CROSS-REFERENCE TO RELATED APPLICATION

The present application is related to my commonly assigned copending application Ser. No. 740,832 filed Nov. 12, 1976 and entitled CASTING APPARATUS, now U.S. Pat. No. 4,102,386.

FIELD OF THE INVENTION

The present invention relates to a process for the shielding of a stream of molten metal dispensed from a casting ladle into a casting mold and, more particularly, for shielding the casting stream of a casting apparatus in which the casting stream over its entire length is surrounded by a protective atmosphere.

BACKGROUND OF THE INVENTION

It is known to provide a casting apparatus, generally consisting of a casting ladle from which a casting stream emerges from its lower end and a casting mold into which the casting stream is fed, with means for surrounding the liquid stream with a protective atmosphere adapted to prevent environmental oxygen from being solubilized in the melt or reacting therewith. It has been found that atmospheric oxygen has a tendency to react with components of the melt to produce scale or slag which detrimentally affects the quality of the casting produced.

The problem is especially pronounced when a so-called continuous casting is to be formed and the molten metal is fed substantially continuously to such a mold from which the solidifying metal emerges at a lower end or, at least, at a downstream end.

To avoid the detrimental effect of atmospheric oxygen on the casting stream, it has been proposed heretofore to direct along the casting stream between the casting ladle and the mold, an inert protective gas, i.e. a protective gas which does not react with the molten-metal stream but which serves to prevent access thereto by atmospheric oxygen.

For many reasons, nitrogen has been found to be the best protective gas for this purpose. For example, it is practically nonreactive and insoluble in the molten metal and, moreover, is relatively inexpensive, available in highly pure form and has a density and molecular weight such that it is effective to exclude the ambient atmosphere from contacting the stream.

Various techniques, including those described in the aforementioned application, have been used to ensure that a complete and uninterrupted blanket of the protective atmosphere will be interposed between the ambient atmosphere and the stream. For example, the casting stream can be led from the ladle to the mold through a tube or duct through which the inert gas is passed. This duct can be connected to the bottom of the casting ladle and, moreover, the protective atmosphere can, via gas distributors surrounding the stream, be directed along the latter.

This technique has, however, a significant disadvantage. Because the melt, i.e. the casting stream, contains dissolved oxygen, in spite of the fact that it is surrounded by the protective gas atmosphere, there is a significant reaction upon cooling of the melt between the entrained oxygen and any deoxidation agents included in the melt, thereby forming a slag which has the disadvantages mentioned above. In other words, the protective atmosphere, while preventing access of ambient oxygen to the casting stream, cannot counteract the effect of entrained oxygen which has previously solubilized in the melt.

OBJECTS OF THE INVENTION

It is the principal object of the present invention to provide a process for the shielding of a casting stream of a casting apparatus such that oxidation from external oxygen and undesired gas pickup by the flowing metal is substantially completely excluded while simultaneously oxygen previously solubilized in the casting stream is removed in an inexpensive and technologically convenient manner.

Still another object of the invention is to provide a process for shielding a molten metal stream, generally a casting stream, against oxidation, whereby the disadvantages of the earlier systems described above are obviated.

Still another object of the invention is to provide a process for the shielding of a casting stream between the casting ladle and a mold against oxidation which extends the principles set forth in the above-identified copending application.

SUMMARY OF THE INVENTION

These objects and others which will become apparent hereinafter are attained, in accordance with the present invention, by shielding the casting stream with a gas mixture which consists of a reaction-inhibiting and/or inert carrier gas and a reactive additive gas which is capable of performing a reducing function, i.e. has a propensity toward reaction with solubilized oxygen in the casting stream.

Preferably the reaction-inhibiting or inert carrier gas constitutes the major component of the gas mixture which can include a minor proportion of the reactive and preferably reducing additive gas. It has been found, most surprisingly, that this additive gas tends to diffuse at least in part into the melt and is capable of reacting therein with previously solubilized oxygen and, in addition, reacts with any oxygen which may be released from the melt preferentially, i.e. practically to the exclusion of a reaction between the oxygen and the deoxidizing agents which may also be present in the melt. Considered in total, therefore, the use of the gas composition according to the invention results in a reduction of the oxygen level in the melt entering the casting mold beneath the level present in the molten metal when it begins its flow along the molten-metal path, channel or duct.

In addition, because the preponderence of the gas mixture is a reaction-inhibiting or inert carrier gas, the protective effect of the gas atmosphere against the pickup of gas from the environment by the casting stream is maintained and hence the protective effect is reinforced by the reaction with solubilized oxygen so that there is a complete exclusion of slag formation in the melt or, at the very least, a substantial reduction in the formation of slag and scale.

I have also found that the reduction of the oxygen supplied from the ambient atmosphere to the melt and the elimination of solubilized oxygen from the melt in the manner described alters the characteristics of the molecules of the melt along the surface thereof, namely, by reduction of the molecular attraction forces. This results in a reduction in the surface tension of the liquid metal stream. This effect has the advantage that, upon the formation of the surface of skin of the solidifying product, soluble gases are released more readily and slag is similarly shed by the solidifying mass relatively rapidly, thereby producing a cleaner casting.

Still another advantage of the process according to the present invention is that it renders visible the protective gas atmosphere surrounding the casting stream because of the exothermic reaction, i.e. combustion reaction, of the additive gas with oxygen in the ambient atmosphere and oxygen within the melt. The visibility of the protective gas atmosphere is particularly desirable when, as described in the aforementioned copending application, protection of service personnel is necessary by providing a blanket of cooling air between the service personnel and the casting stream, e.g. by blowing it transversely to the casting stream. In this case, should the protective gas curtain fail, it would no longer be visible and the service personnel would be readily able to recognize this fact and take corrective measures both to protect themselves and to restore the oxidation-limiting gas curtain or shield.

It is preferable to form the gas mixture of the present invention with nitrogen as the carrier or reaction-inhibiting gas, although other inert gases such as argon or helium can be employed. The additive gas is preferably a hydrocarbon such as methane or propane. Such a gas mixture has characteristics which render it highly suitable. For example, the gas mixture is not poisonous or toxic, is easily formed and easily handled, so that expensive safety measures need not be taken, and the mixture can be relatively inexpensive. For this reason the aforementioned mixture is the preferred composition for the protective gas atmosphere for the casting stream of the casting apparatus.

However, other reactive additive gases can be used. For example, the reactive gas can be a substituted hydrocarbon, for example, a fluoro-chloro hydrocarbon of the freon type, or a boron-methyl ester. Naturally, gasifiable liquids which fulfill the requirements discussed above and have similar characteristics to the gases mentioned, can be used and can be vaporized on contact with the gas stream or prior thereto.

Best results have been obtained when the gas mixture consists of 5 to 20 volume percent of the reducing gas, i.e. the hydrocarbon, the balance (95 to 80 volume percent) being constituted by the carrier or reaction-inhibiting gas. With this composition, the protective gas atmosphere has been found to have a sufficient shielding effect against the environment at the same time to be capable of reacting with at least part of the oxygen liberated from the casting stream or solubilized therein. With such a concentration of the additive gas, significant diffusion of this gas into the melt to react with the solubilized oxygen therein, preventing a reaction with deoxidizing agents or their residues in the melt, has been found to occur. It is also surprising that any of the reactive gas which diffuses into the melt appears to be discharged therefrom upon cooling or during incipient solidification so that it does not create new problems.

The process of the present invention is preferably carried out in conventional apparatus adapted to provide a blanked of protective gas surrounding the casting melt and, preferably, with apparatus disposed in the casting plant and/or the continuous casting device. However, the preferred apparatus is that described in the aforementioned copending application which is modified, as is described below, to provide means for mixing the hydrocarbon or reducing reactive gas with the inert or carrier gas.

BRIEF DESCRIPTION OF THE DRAWING

The above and other objects, features and advantages of the present invention will become more readily apparent from the following description, reference being made to the accompanying drawing in which:

FIG. 1 is a diagrammatic vertical section through a portion of a casting apparatus embodying the invention;

FIG. 2 is a section through a further embodiment of the invention;

SPECIFIC DESCRIPTION

Figure 4:
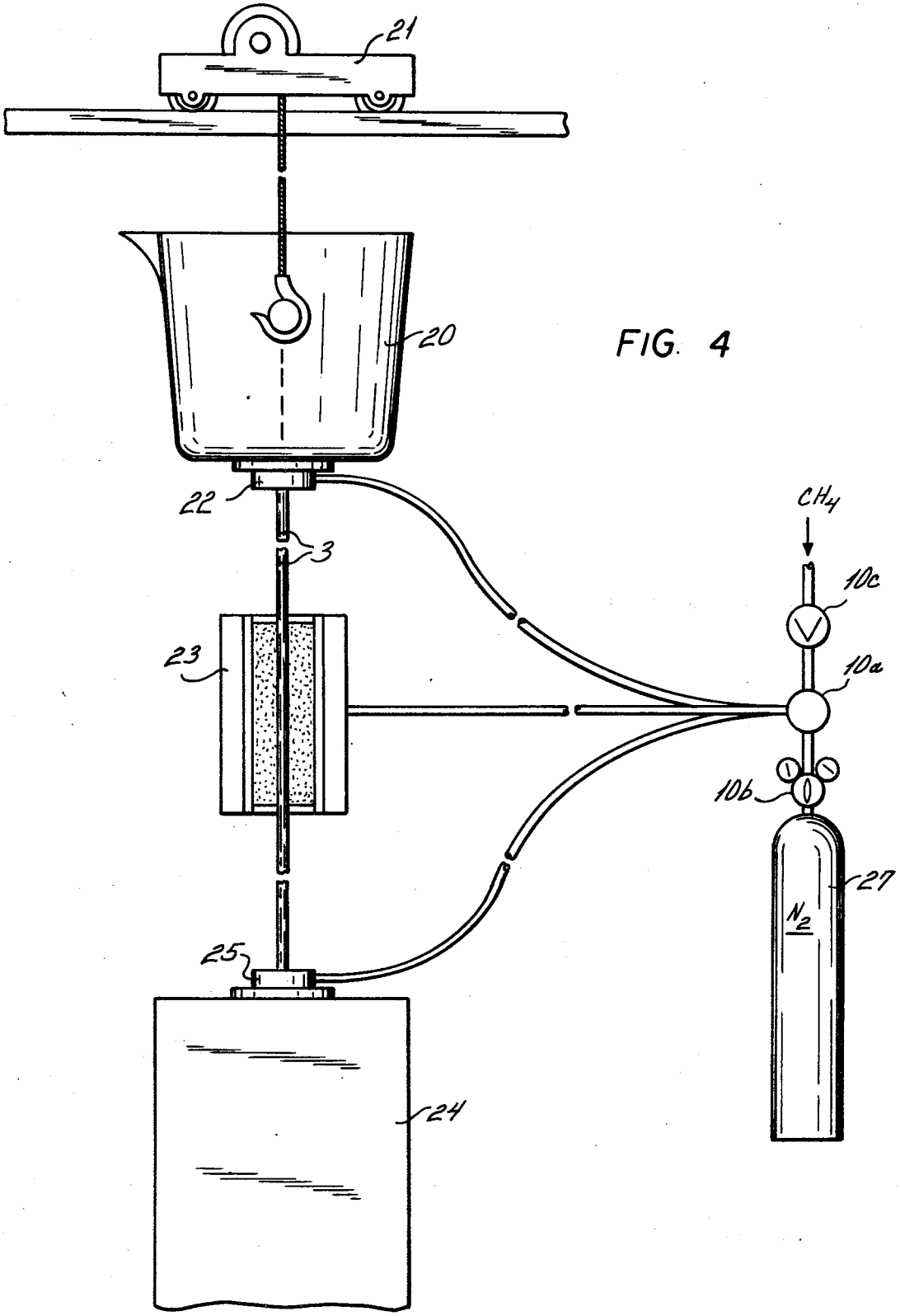
FIG. 4 is a diagrammatic elevational view illustrating an aspect of the invention.

Referring first to FIG. 4 it can be seen that an apparatus for casting can include a ladle 20 supported by the usual crane 21 and provided around its tap hole with a device for producing an inert gas curtain generally represented at 22 and identical to the device shown in FIG. 1 for this purpose.

Figure 3:
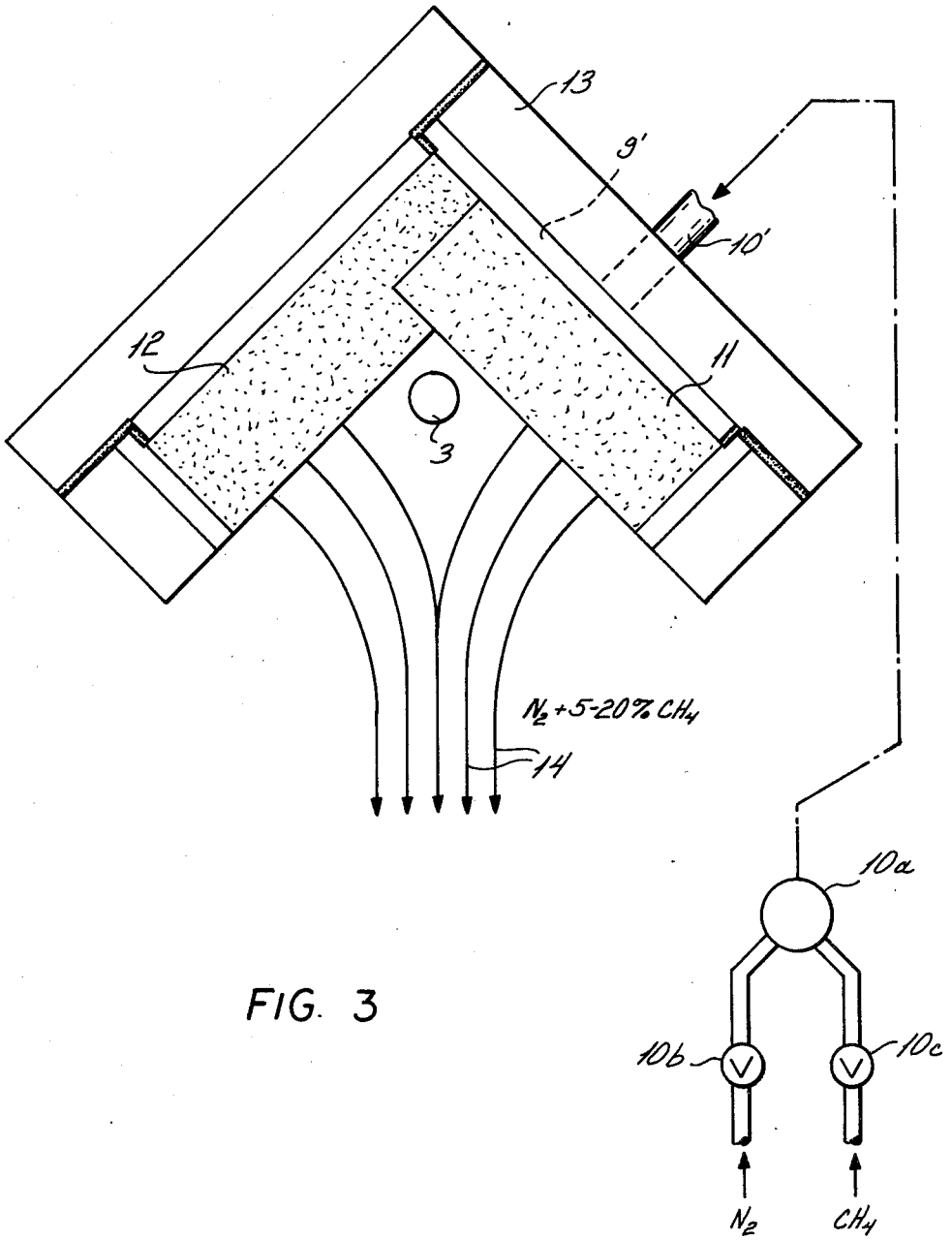
FIG. 3 is a horizontal section through still another embodiment of the invention.

For the most part, the casting metal stream 3 from this ladle is unobstructed and can pass over part of its length through the crotch of a device 23 similar to that shown in FIG. 3 for providing an inert gas curtain over at least a portion of the length of the stream. The stream then passes in a casting mold 24 which can be surmounted by a further device 25 identical to that shown in FIG. 2 to further shield the metal stream with inert gas.

In FIGS. 1–3 similarly functioning parts are designated by the same reference numeral although, where the parts are structurally different, they are distinguished from those of preceding FIGURES by primed numerals.

FIG. 1 shows a casting ladle 1 or a tundish (*The Making, Shaping and Treating of Steel,* US Steel Corp., 1971, page 707 ff.) having an outlet 2 from which emerges a casting stream 3 of molten metal, the stream passing into a casting mold 4.

A metal plate 8 is affixed to the base of the ladle 1 by bolts **8*a* and has a central bore 8*b* which is aligned with the outlet 2 and coaxially receives the stream 3 of casting metal. The metal plate 8 is composed of a ferromagnetic material, e.g. iron or steel, to form a magnetically attractable support for the magnetic shank 6*a* of a Z-section metal bracket 6 which is secured by magnetic force to the plate 8 within a ridge 8*c*** of the latter.

The shanks **6*a*, 6*b* and 6*c* of this bracket 6 extend at right angles to one another. The lower shank 6*c* extends toward the axis of the stream 3 and forms an abutment 7 which engages a gas-permeable refractory annular body 5 which is of cylindrical configuration so that a section through one half of the body parallel to the axis has the configuration of a rectangle. The body 5 can rest directly against the plate 8**.

The shank **6*b* of the bracket 6 is spaced from the outer surface of the body 5 to define therewith an annular gap 9 forming a chamber which is supplied by a duct 10 with the protective gas mixture from a mixing chamber 10*a* fed with nitrogen from a supply tank 27 (FIG. 4), and with, for example, methane via valves 10*b* and 10*c***.

The protective gas mixture traverses the gas-permeable material of the body 5 under the pressure of the tank and methane source and passes into contact with and along the stream 3 as represented by the arrows 5*a*. Preferably a laminar flow of the gas mixture along the stream 3 is maintained by controlling the pressure of the nitrogen and/or methane.

In FIG. 2 we have shown a modified system in which the plate 8 is bolted to the mold 4 and thus has the Z-section bracket reversed by 180° from the configuration illustrated in FIG. 1. Otherwise the system of FIG. 2 is identical to that of FIG. 1 except that the protective gas flows upwardly as represented by the arrows 5*a*′ and thence downwardly as represented by the arrows 5*b*′.

In FIG. 3, however, shows still another device in which the gas distributor consists of a pair of blocks 11 and 12 of gas-permeable, high-temperature resistant material seated in metal brackets 13 which have a Z-cross-section. The blocks 11 and 12 adjoin the right angles in a V-configuration so that the stream of molten metal 3, flowing perpendicular to the plane of the paper in FIG. 3, passes along the crotch of the V.

In this embodiment as well, gas is supplied, e.g. via a duct 10′ to a passage 9′ behind the block.

Arrows 14 show the flow of gas from individual pores of the block traversed to the molten-metal stream, these flows being in addition to the flow of the gas mixture which is entrained with the stream. The flows 14 meet at the open side of the distributor and thus prevent passage of air into contact with the molten-metal stream 3.

I claim:

1. A process for shielding a casting stream of a casting apparatus from oxidation by oxygen in the ambient atmosphere which comprises the steps of:

passing said stream from an outlet of a casting ladle into an inlet end of a casting mold along a flow path with free fall between the outlet and said inlet, the free-fall portion of said path being unconfined thereby being in direct communication with the ambient atmosphere; and blanketing said stream along said unconfined portion of said path with a gas mixture consisting essentially of a first carrier gas which consists of nitrogen and a second reactive carbon-containing additive gas capable of reacting with oxygen in said stream and the oxygen in the ambient atmosphere, said second gas being selected from the group which consists of unsubstituted and substituted hydrocarbons, the gas mixture being spread along said unconfined portion of said path by forcing it through a porous body juxtaposed with said stream and freely surrounding same, said gas mixture consisting of 5 to 20% by volume of a hydrocarbon, the balance being nitrogen.

2. The process defined in claim 1 wherein said hydrocarbon is selected from the group which consists of methane and propane.

* * * * *